US010128605B2

(12) United States Patent
Takeuchi

(10) Patent No.: US 10,128,605 B2
(45) Date of Patent: Nov. 13, 2018

(54) CONNECTOR

(71) Applicant: Sumitomo Wiring Systems, Ltd., Yokkaichi, Mie (JP)

(72) Inventor: Michiyo Takeuchi, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/646,436

(22) Filed: Jul. 11, 2017

(65) Prior Publication Data

US 2018/0026390 A1 Jan. 25, 2018

(30) Foreign Application Priority Data

Jul. 19, 2016 (JP) ..... 2016-141230

(51) Int. Cl.

| | |
|---|---|
| ***H01R 31/08*** | (2006.01) |
| ***H01R 13/502*** | (2006.01) |
| ***H01R 24/20*** | (2011.01) |
| ***H01R 24/66*** | (2011.01) |
| ***H01R 13/52*** | (2006.01) |
| *H01R 103/00* | (2006.01) |

(52) U.S. Cl.

CPC ..... *H01R 13/5025* (2013.01); *H01R 13/5202* (2013.01); *H01R 24/20* (2013.01); *H01R 24/66* (2013.01); *H01R 2103/00* (2013.01)

(58) Field of Classification Search

CPC .... H01R 2103/00; H01R 24/66; H01R 24/20; H01R 13/5202

USPC ..... 439/136, 607.21, 509, 512

See application file for complete search history.

(56) References Cited

U.S. PATENT DOCUMENTS

| | | | | |
|---|---|---|---|---|
| 6,224,238 | B1 * | 5/2001 | Chen | F21V 19/0005 362/654 |
| 8,579,655 | B2 * | 11/2013 | Kawamura | H01R 13/6315 439/353 |
| 9,024,183 | B2 * | 5/2015 | Sakakura | H01R 13/5202 174/50.5 |
| 9,397,459 | B2 * | 7/2016 | Butcher | H01R 33/95 |
| 2012/0282789 | A1 * | 11/2012 | Kawamura | H01R 13/6315 439/136 |

(Continued)

FOREIGN PATENT DOCUMENTS

JP 2012-248415 12/2012

*Primary Examiner* — Abdullah Riyami
*Assistant Examiner* — Nelson R Burgos-Guntin
(74) *Attorney, Agent, or Firm* — Gerald E. Hespos; Michael J. Porco; Matthew T. Hespos

(57) ABSTRACT

A connector (10) to be mounted into an attaching member (60) provided detachably to a case (80) of a device accommodating a waiting connector (90) to face the waiting connector (90) and to be connected to the waiting connector (90) includes a housing (20) configured to accommodate a terminal (50) and a movable member (40) forming a wire accommodating portion (41) together with the connector housing (20). The wire accommodating portion (41) is configured to accommodate a wire W connected to the terminal (50), and including a held portion (45) to be held movably within a plane perpendicular to a connecting direction to the waiting connector (90) with respect to a holding portion (70) provided in the attaching member (60), and a coupling (37, 39, 43) configured to couple the housing (20) and the movable member (40).

3 Claims, 13 Drawing Sheets

(56) References Cited

U.S. PATENT DOCUMENTS

2014/0148034 A1* 5/2014 Kashiwada ..... H01R 13/512
439/345
2014/0148045 A1* 5/2014 Kashiwada ..... H01R 13/6592
439/485

* cited by examiner

CONNECTOR

BACKGROUND

1. Field of the Invention

This specification relates to a connector.

2. Description of the Related Art

Some device cases have an opening so that a terminal block and a busbar can be fastened in the case. A service cover is attached to the case to close the after a bolt fastening operation is completed so that water, dust and the like do not intrude into the interior of a device through this opening. An interlock circuit may be provided as a safety measure to shut off an electrical circuit in the device after removing the service cover from the case. Specifically, the interlock circuit is configured by connecting a waiting connector provided in the device and an interlock connector attached to the service cover. Power can be applied to the electrical circuit in the device in this connected state. On the other hand, the interlock circuit is shut off and the electrical circuit in the device also is shut off when the service cover is removed from the case and the interlock connector is separated from the waiting connector.

Japanese Unexamined Patent Publication No. 2012-248415 discloses such a service cover mounted with the interlock connector of the interlock circuit. The interlock connector is attached to a cover movably in a direction perpendicular to a connecting direction to absorb a positional displacement between the connectors.

However, a terminal used in the interlock connector of Japanese Unexamined Patent Publication No. 2012-248415 is a dedicated shorting terminal in which two pin-like terminals are coupled. This dedicated terminal needs to be fabricated for each interlock connector and leads to a cost increase. Accordingly, it is thought to use general-purpose terminals and connect those terminals by a wire. However, a connector housing that is movable with respect to a service cover while the terminals and the wires are accommodated in the connector housing must have a long length, thereby causing a problem that a molding failure easily occurs in the connector housing.

SUMMARY

The invention relates to a connector to be mounted in an attaching member that is attachable to a case of a device. The case accommodates a waiting connector, and the connector faces the waiting connector so that the connector can be connected to the waiting connector. The connector includes a housing configured to accommodate a terminal and a movable member that cooperates with the housing to form a wire accommodating portion. The wire accommodating portion is configured to accommodate a wire connected to the terminal, and includes a held portion that is held movably within a plane perpendicular to a connecting direction to the waiting connector with respect to a holding portion provided in the attaching member. A coupling is configured to couple the connector housing and the movable member.

In this configuration, the housing and the movable member can be separate members used by being coupled. Thus, both the housing and the movable member are reduced in size as compared to the case where the housing is integral with a moving structure with respect to the attaching member. Therefore, a molding failure is avoided.

The housing may have an opening on a side opposite to the side that connects to the waiting connector, and the terminal may be insertable into the opening. The held portion may comprise an engaging piece and the holding portion may comprise an engaging groove that is engaged by the engaging piece. The engaging groove may be on an end part of the movable member on the side of the attaching member. The engaging piece may project in a predetermined direction within a plane perpendicular to the connecting direction to the waiting connector. The engaging groove may extend in a direction intersecting a projecting direction of the engaging piece within the plane perpendicular to the connecting direction to the waiting connector. A clearance may be provided between the engaging piece and an inner wall of the engaging groove to enable the connector to move in an extending direction of the engaging groove. The held portion may comprise a resilient locking piece on the movable member and the holding portion may comprise an accommodating portion to which the resilient locking piece is locked. The resilient locking piece may project toward the attaching member within the plane perpendicular to the connecting direction to the waiting connector and may extend in the projecting direction of the engaging piece. A clearance for moving the connector in an extending direction of the resilient locking piece may be provided between the resilient locking piece and the accommodating portion, and the resilient locking piece may be arranged above the opening.

In this configuration, a clearance exists between the engaging piece and the inner wall of the engaging groove and a clearance exists between the resilient locking piece and the inner wall of the accommodating portion. Thus, the connector is movable relative to the attaching member within dimensions of these clearances. Further, the resilient locking piece extends in the projecting direction of the engaging piece. Thus, the resilient locking piece can be locked and retained in the accommodating portion merely by pushing the movable member into the attaching member with the engaging piece engaged with the engaging groove. Further, the resilient locking piece is above the opening that receives the terminal so that miniaturization is possible.

A press-fit rib may be provided on an outer surface of the housing and may be pressed into contact with an inner surface of the waiting housing and squeezed when connecting the housing to the waiting housing, thereby fixing the housing and the waiting housing together. A rubber plug may be mounted on the wire to be held in close contact with an outer peripheral surface of the wire and a cavity of the housing when the terminal is accommodated in the cavity.

The connector is held movably with respect to the attaching member, the connector and the waiting connector may move due to vibration. Accordingly, if the housing is connected to the waiting connector by this configuration, the press-fit rib is pressed into contact with the waiting connector to be squeezed, and the housing and the waiting housing are fixed integrally. Further, the terminal may relatively move due to a clearance formed between the cavity and the wire. However, relative movement of the wire with respect to the cavity can be suppressed by holding the rubber plug in close contact so that a relative movement of the terminal can be suppressed.

Accordingly, it is possible to suppress a molding failure.

DETAILED DESCRIPTION

Figure 1:
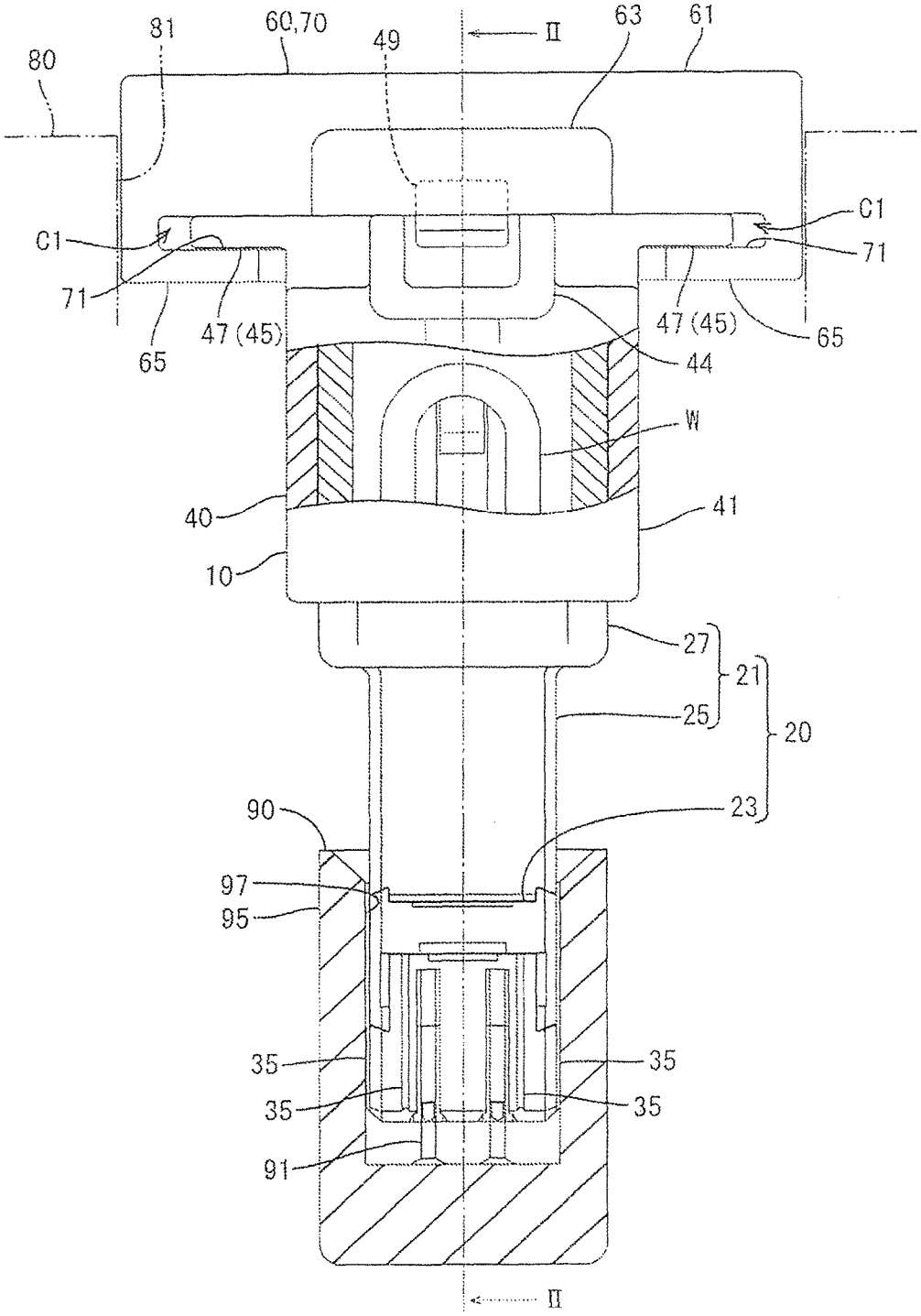
FIG. 1 is a front view partly in section showing a state where a connector according to an embodiment and a waiting connector are connected.
Figure 2:
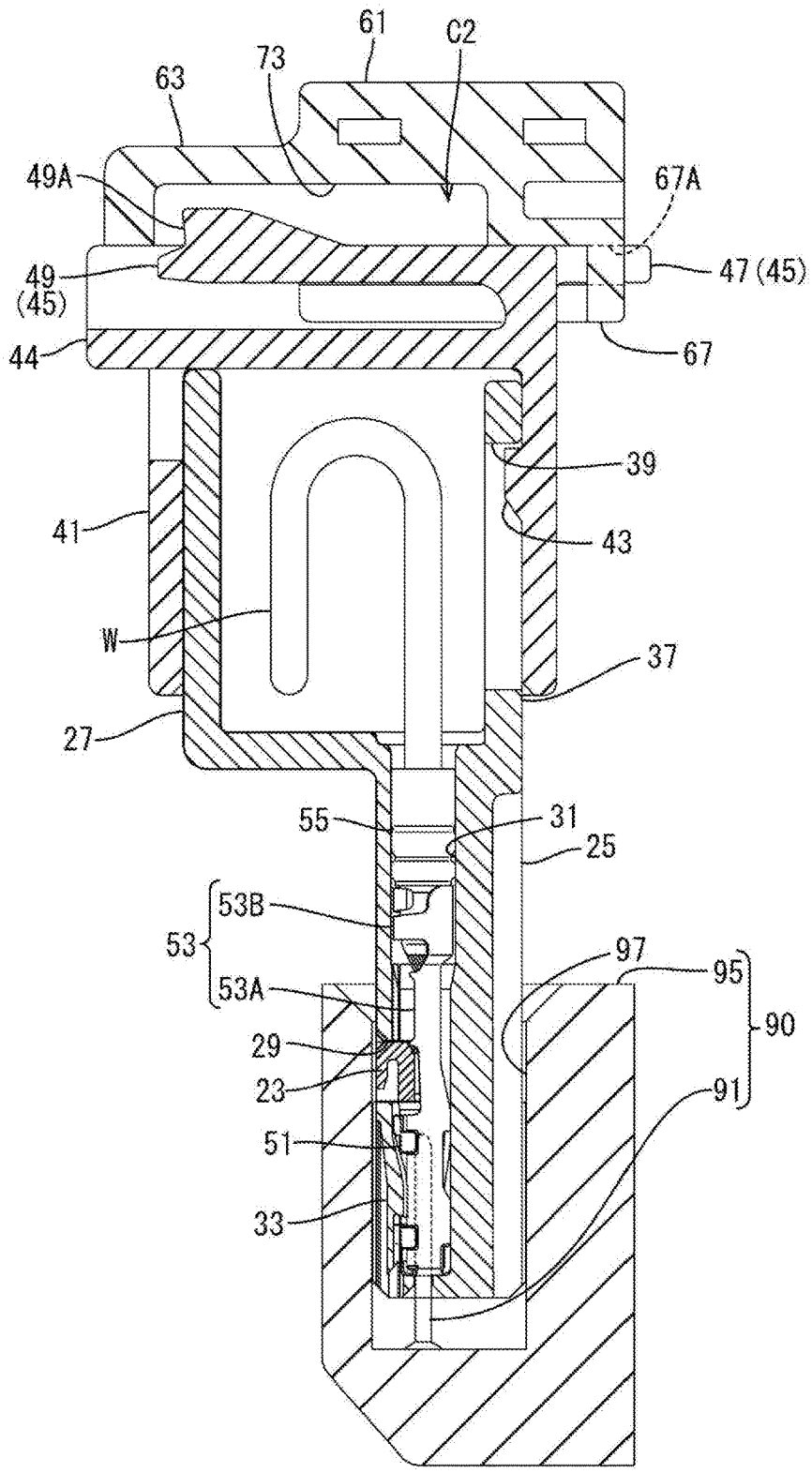
FIG. 2 is a section along II-II in FIG. 1.
Figure 3:
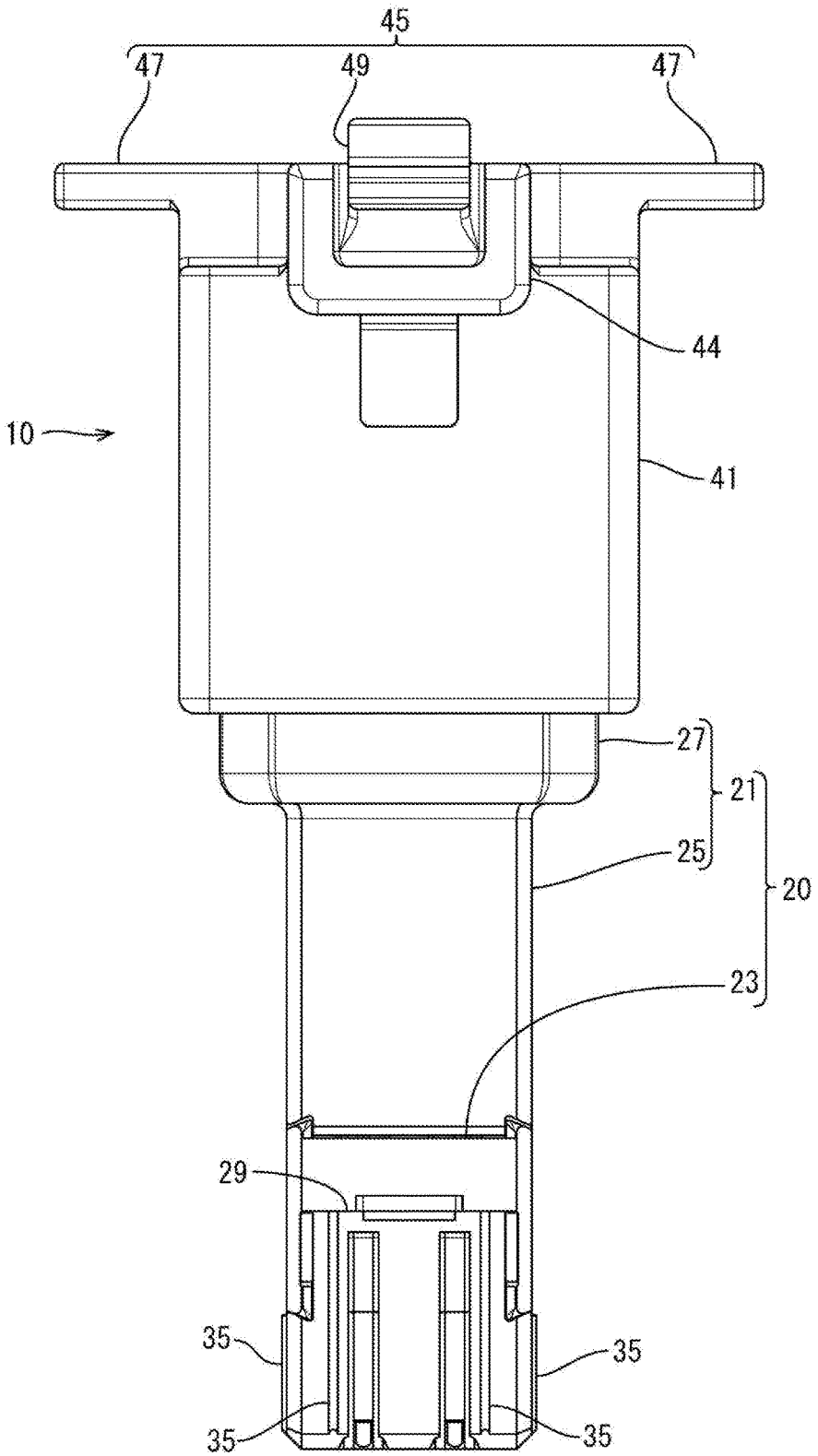
FIG. 3 is a front view of the connector.
Figure 4:
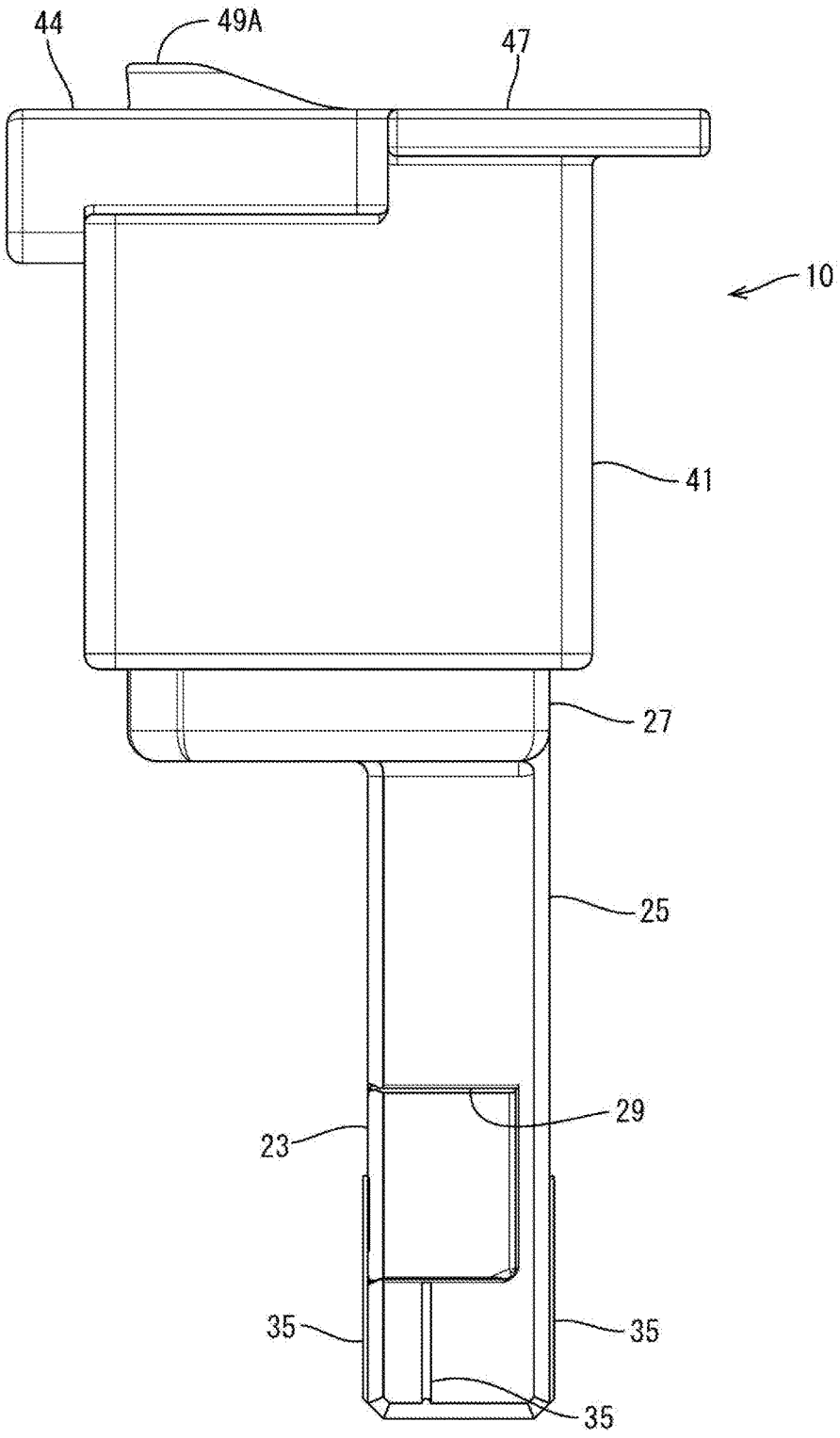
FIG. 4 is a side view of the connector.
Figure 5:
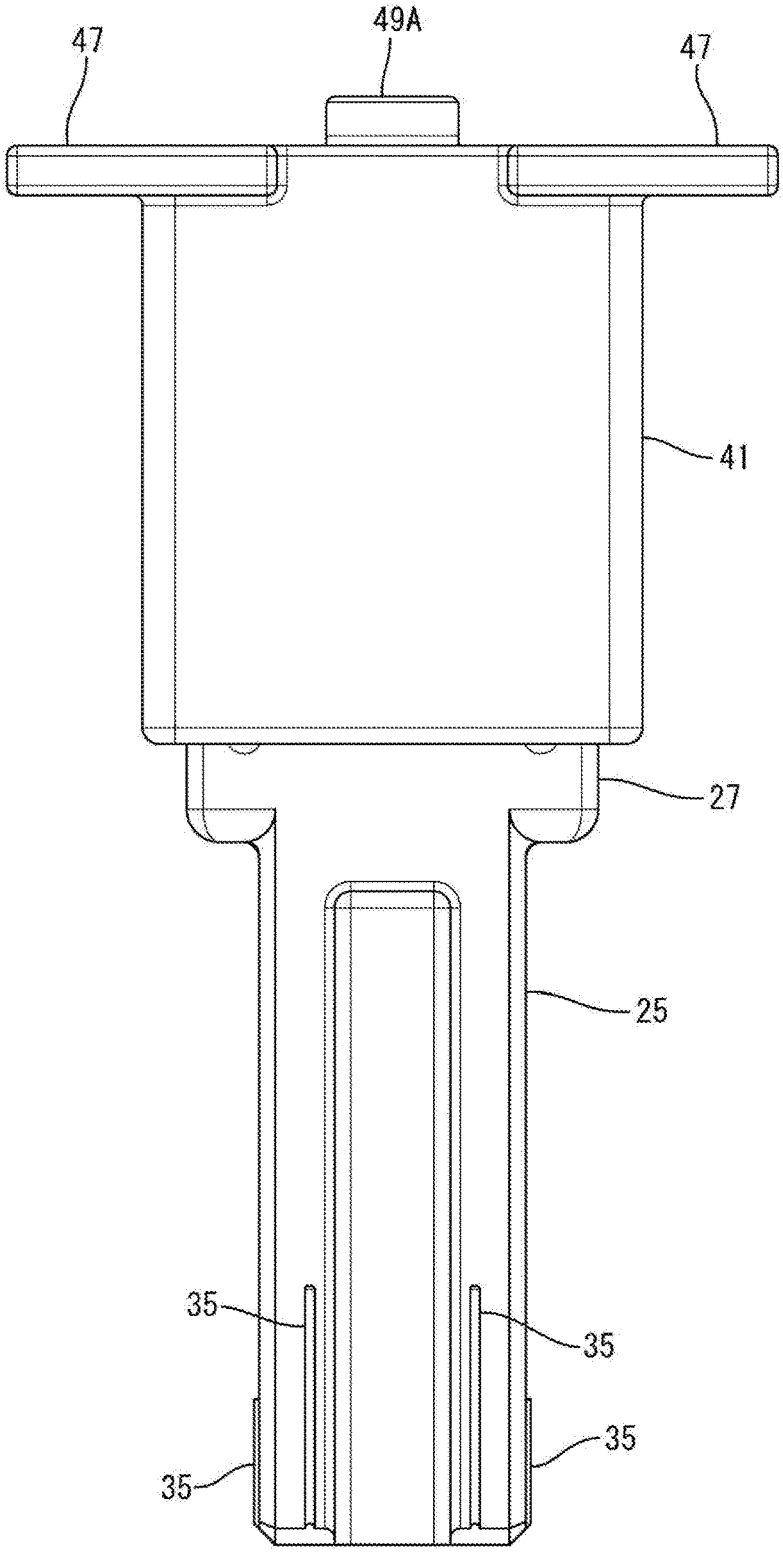
FIG. 5 is a back view of the connector.

An embodiment is described with reference to FIGS. 1 to 13. This embodiment has a connector 10 assembled with an attaching member 60 to be attached to a case 80 of an electrical device in a vehicle, as shown in FIGS. 1 and 2. In the following description, an upward direction in FIGS. 1 and 2 (separating direction of the connector 10) is referred to as an upward direction and a downward direction in FIGS. 1 and 2 (connecting direction of the connector 10) is referred to as a downward direction concerning a vertical direction. Further, a front-rear direction is based on a lateral direction in FIG. 2 and left and right sides in FIG. 2 are referred to as the front and rear.

An opening 81 of the case 80 is provided as a work hole into which a tool for bolt fastening or the like is inserted to fasten together unillustrated conductive members connected to the electrical device. The attaching member 60 is attached removably to the case 80 via an unillustrated cover and the opening 81 is covered by the cover.

Further, as shown in FIGS. 1 and 2, an interlock circuit is provided between the cover that covers the opening 81 and the electrical device in the case 80 for turning on and off the supply of power to the electrical device as the cover is attached and detached. This interlock circuit includes the connector 10 and a waiting connector 90 fixed in the case 80 to face both the opening 81 and the attaching member 60 arranged in the opening 81.

The waiting connector 90 fixed in the case 80 includes tab-like male terminals 91 and a waiting housing 95, as shown in FIGS. 1 and 2. The waiting housing 95 includes a receptacle 97 to be fit externally to a later-described connector housing 20 of the connector 10. An upper end part of the receptacle 97 is flared to have larger inner dimensions toward the top to guide the housing 20 into the receptacle 97.

Figure 8:
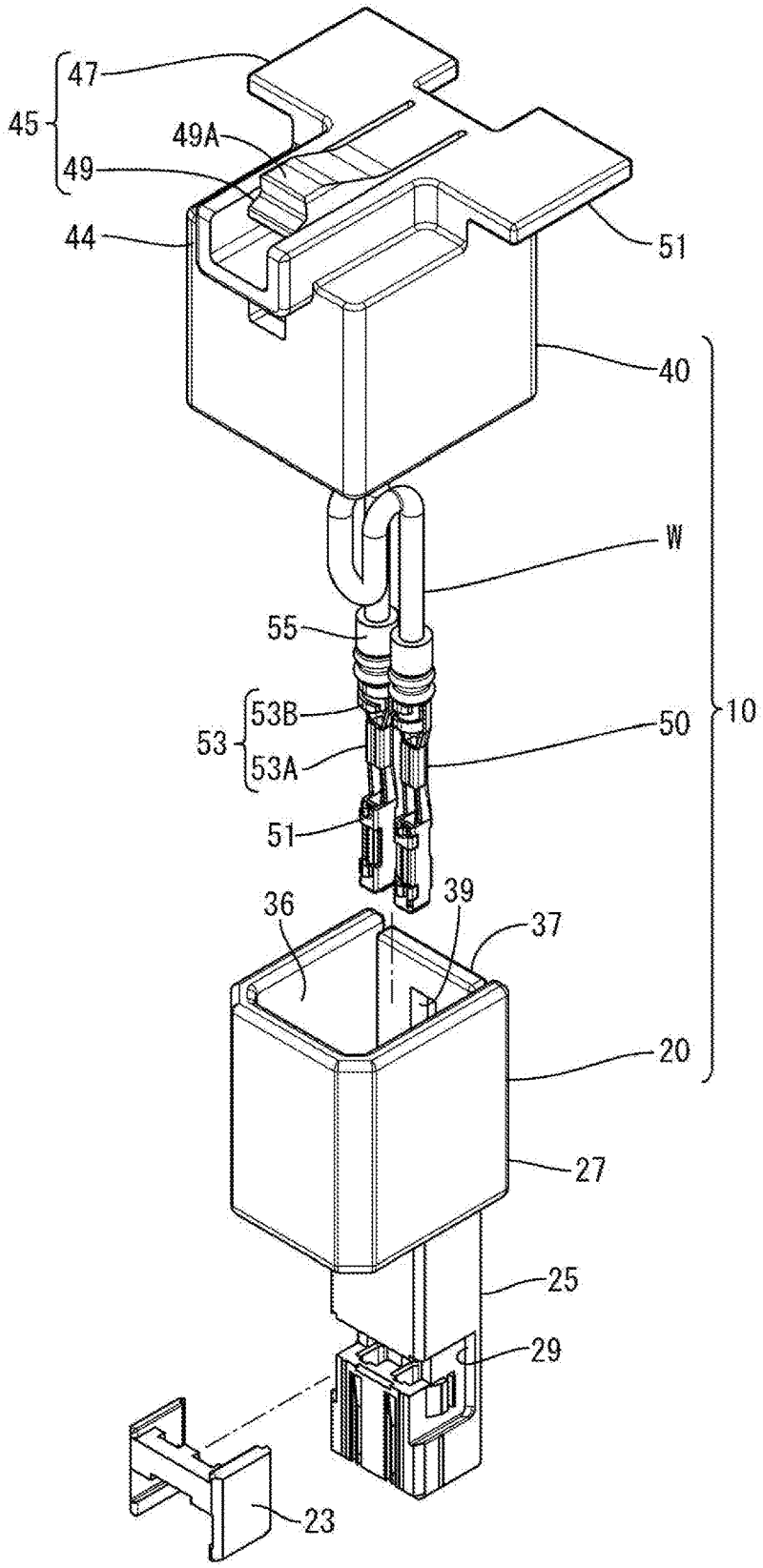
FIG. 8 is an exploded perspective view of the connector.

As shown in FIGS. 2 and 8, the connector 10 includes the housing 20 made of synthetic resin, a movable member 40 coupled to the housing 20, two female terminals 50 in the housing 20 and a wire W linking between the two female terminals 50.

Figure 9:
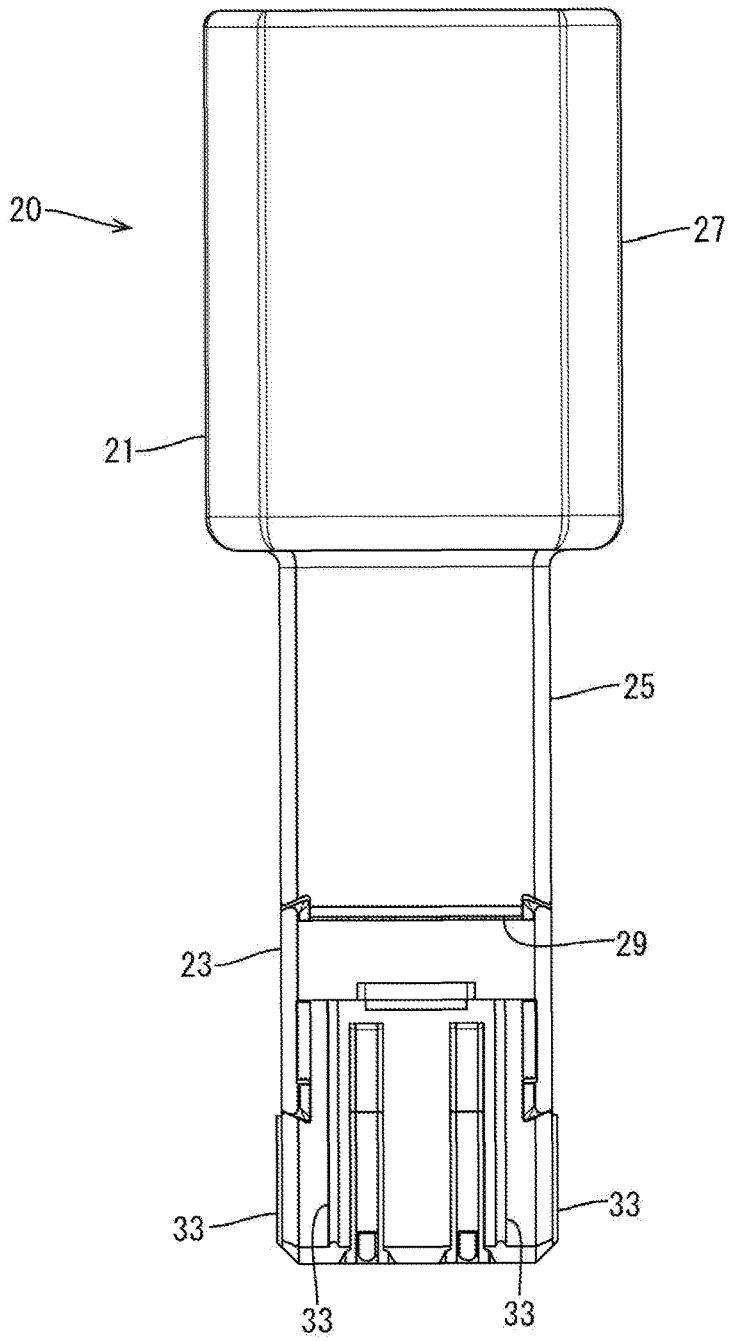
FIG. 9 is a front view of a housing having female terminals therein.

As shown in FIGS. 8 and 9, the housing 20 is long vertically and includes a housing body 21 and a retainer 23 configured to lock the female terminals 50. The housing body 21 includes a fitting 25 configured to accommodate the female terminals 50 and to be fit into the waiting housing 95, and a lower wire accommodating portion 27 configured to accommodate the wires W connected to the female terminals 50.

As shown in FIGS. 2 and 8, the fitting 25 is a rectangular column with chamfered corners. Two laterally adjacent cavities 31 penetrate the fitting 25 in the vertical direction and can accommodate the female terminals 50. A locking lance 33 is provided in the cavity 31 and achieves primary locking of the female terminal 50 that has been inserted to a proper position from above the cavity 31. Further, a mounting hole 29 is provided in the fitting 25 at a position above the locking lances 33 and the retainer 23 can be mounted therein. The retainer 23 achieves secondary locking of the female terminals 50 that have been locked primarily by the locking lances 33.

Figure 6:
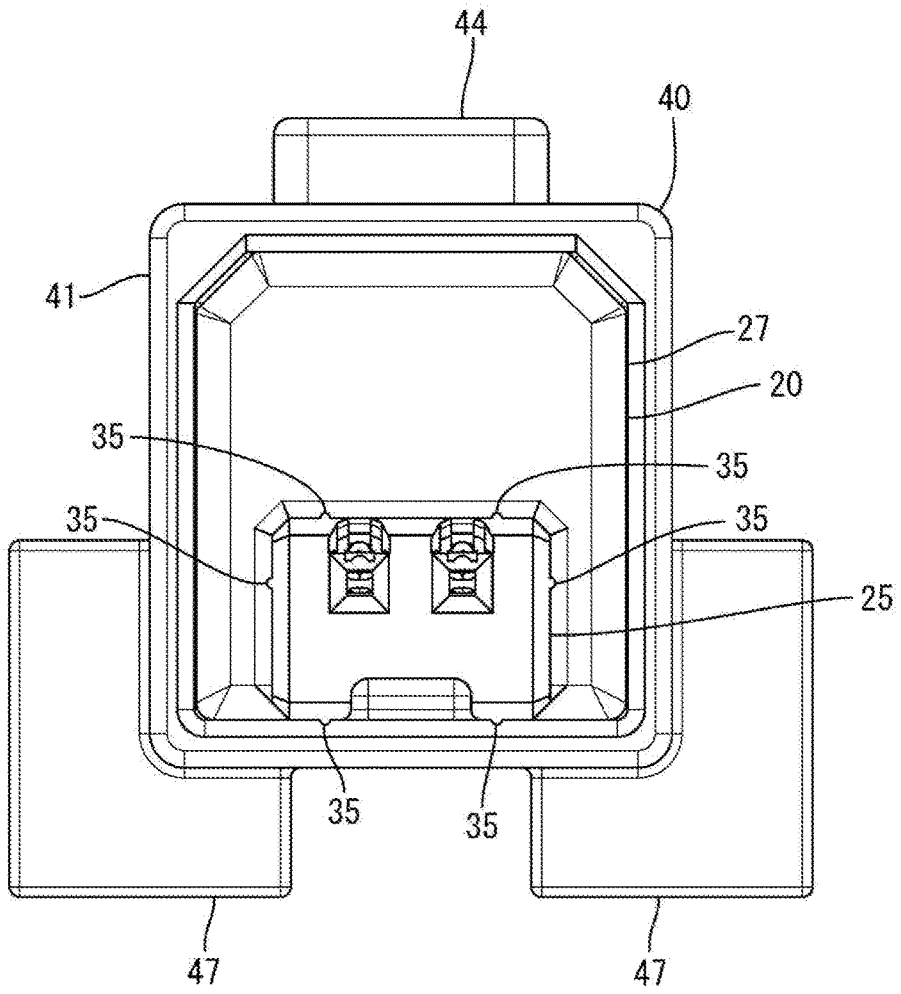
FIG. 6 is a bottom view of the connector.
Figure 7:
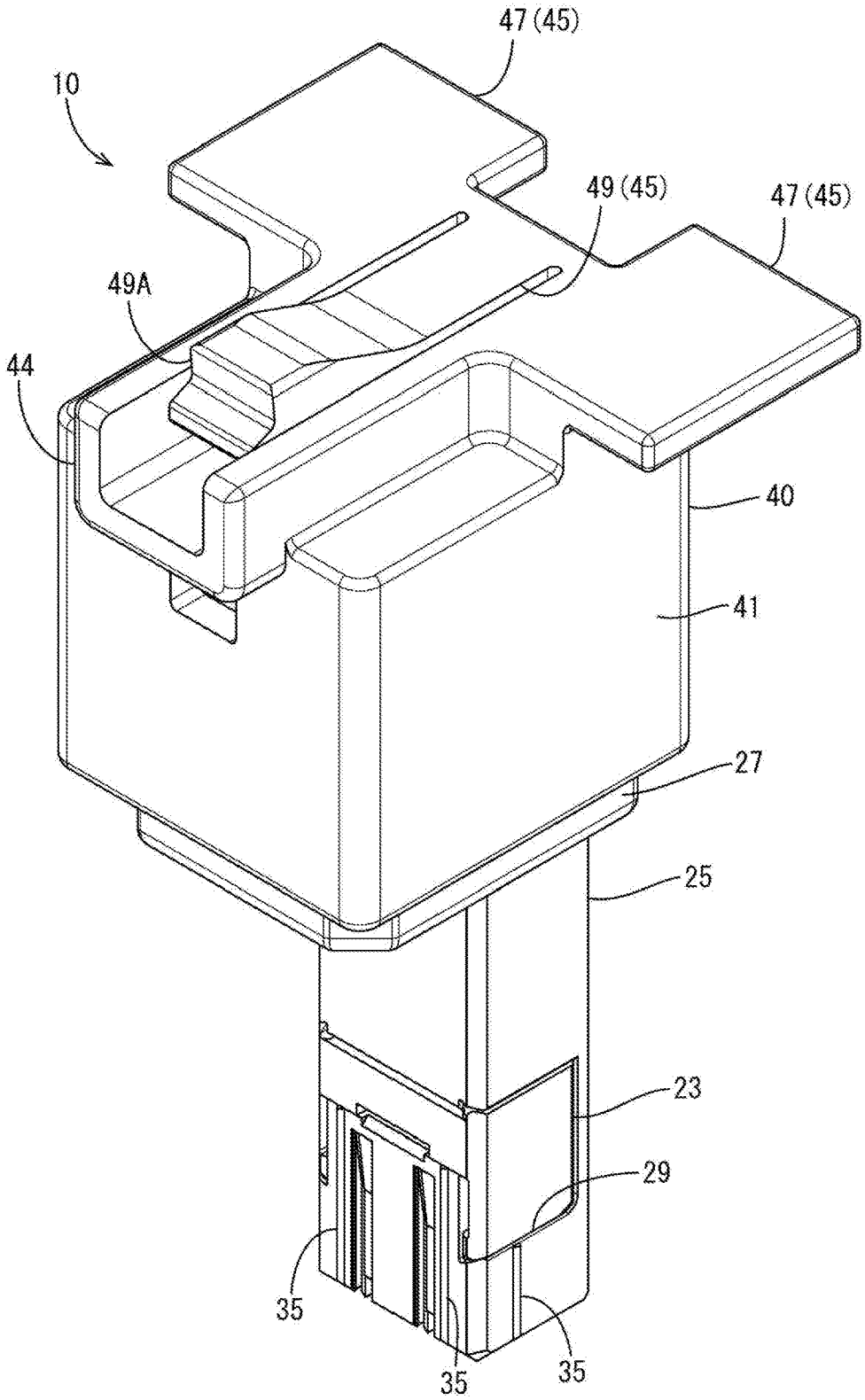
FIG. 7 is a perspective view of the connector.

Further, as shown in FIGS. 6 and 7, press-fit ribs 35 are provided on the outer surface of the fitting 25 and are squeezed by being pressed into contact with the inner surface of the receptacle 97. The press-fit ribs 35 are provided on each surface of the fitting 25 and have a semicircular shape in a bottom view. Two press-fit ribs 35 are provided on each of the front and rear surfaces of the fitting 25, and one press-fit rib 35 is provided on each side surface. Outer dimensions of the fitting 25 in a part where the press-fit ribs 35 project are larger than inner dimensions of the receptacle 97. The press-fit ribs 35 are provided from a lower end position of the fitting 25 to a position reaching the mounting hole 29 (on the rear surface, to the same position as on the front surface) and provided on the outer periphery at a position where the male terminals 91 and the female terminals 50 are connected.

Figure 10:
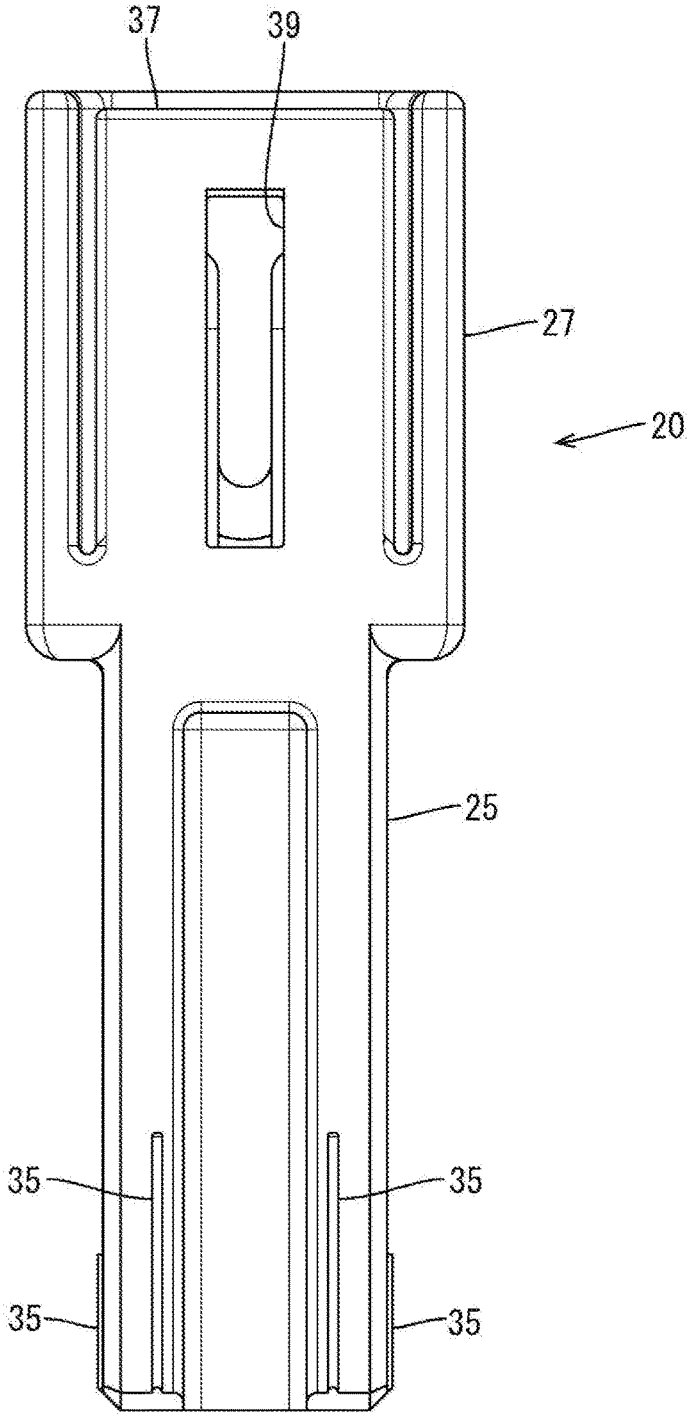
FIG. 10 is a back view of the housing having the female terminals therein.

On the other hand, as shown in FIGS. 8 and 10, the lower wire accommodating portion 27 is a hollow box with an opening 36 that opens up in a direction away from the waiting connector 90. The female terminals 50 and the wires W are insertable through the opening 36 and into the housing 20. Further, the lower wire accommodating portion 27 is wider than the fitting 25, the rear end thereof is located at the same position as that of the fitting 25, but the lower wire accommodating portion 27 projects more forward (left) than the fitting 25. An accommodation space for the wires W is provided in the lower wire accommodating portion 27 and communicates with the cavities 31.

A coupling wall 37 is at the rear of the lower wire accommodating portion 27 and has cuts at opposite widthwise sides so that the coupling wall 37 is resiliently deformable in the front-rear direction. A locking hole 39 penetrates through a widthwise central part of the coupling wall 37 in a plate thickness direction and can receive a locking projection 43 of the movable member 40 to be described later. The locking hole 39 extends up with an equal width from a lower end position of the coupling wall 37 (lower ends of the cuts) and has a rectangular shape in a back view.

Figure 11:
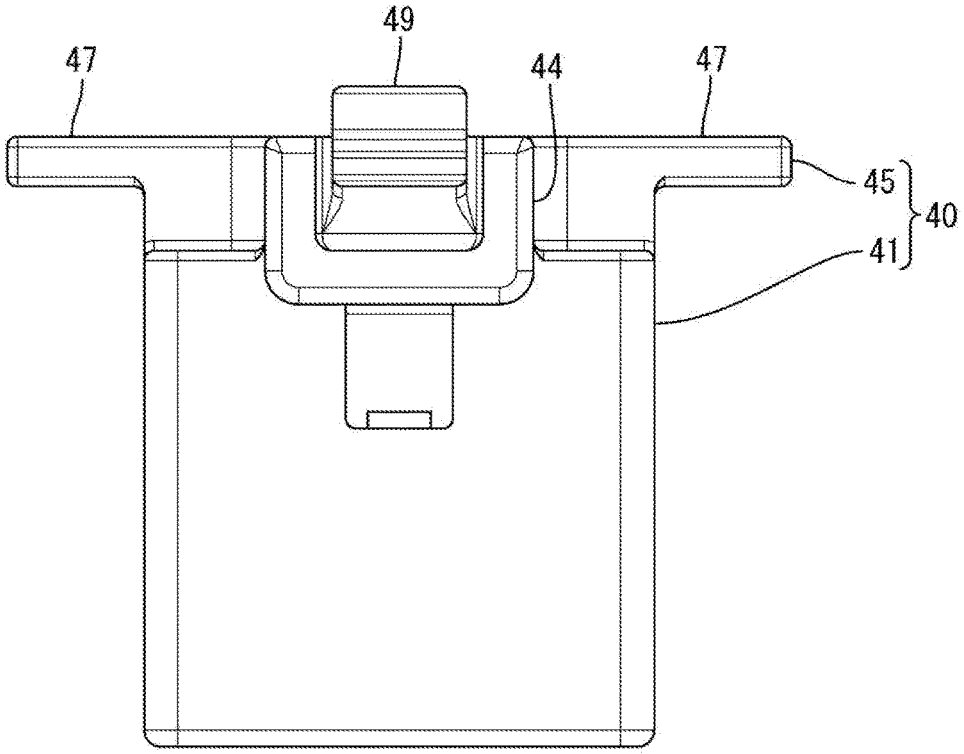
FIG. 11 is a front view of a movable member.

As shown in FIGS. 8 and 11, the movable member 40 is mounted onto the connector housing 20 from above. The movable member 40 is made of synthetic resin and includes an upper wire accommodating portion 41 to be fit externally to the lower wire accommodating portion 27 and has a held portion 45 at an upper end. The upper wire accommodating portion 41 is a downwardly open rectangular box that covers most of the lower wire accommodating portion 27. More specifically, a lower end of the upper wire accommodating portion 41 reaches the lower end of the coupling wall 37, and the inner shape of the upper wire accommodating portion 41 is the same as the outer shape of the lower wire accommodating portion 27. The lower and upper wire accommodating portions 27, 41 can be assembled to form a wire accommodating portion for accommodating the wire W. The locking projection 43 ("coupling portion") projects in (forward) from the rear wall of the upper wire accommodating portion 41, as shown in FIG. 2 and can be locked to the locking hole 39 to assemble the movable member 40 with the housing 20.

Figure 12:
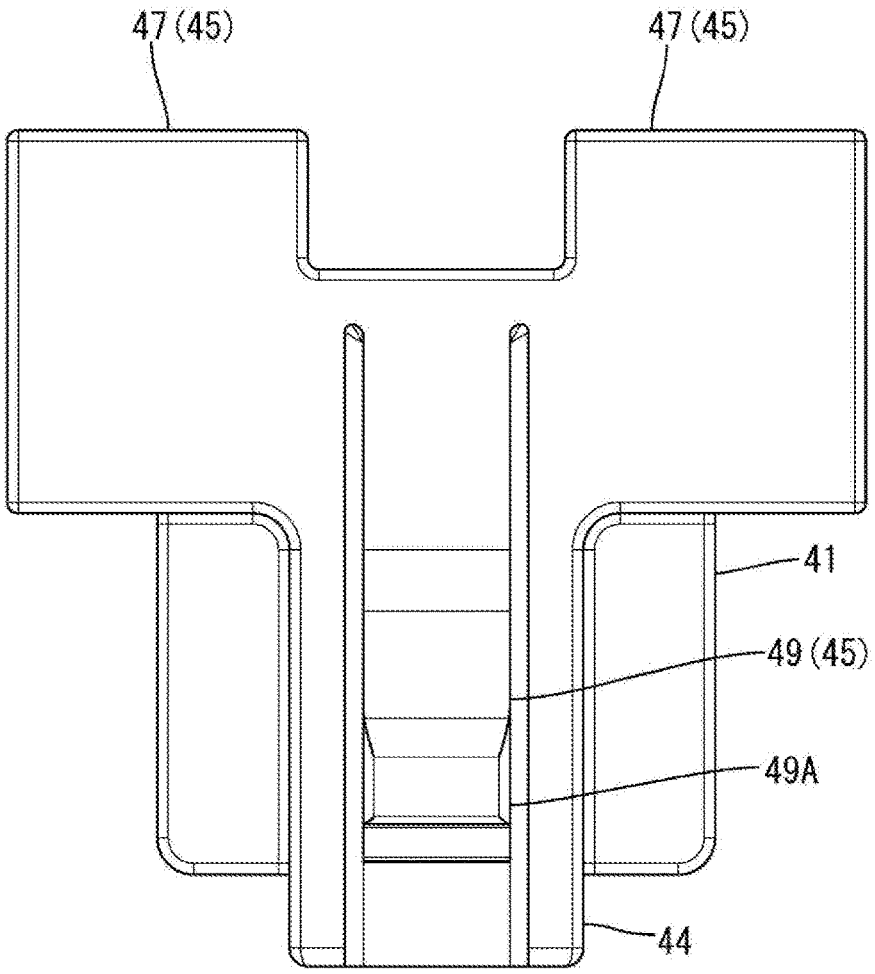
FIG. 12 is a plan view of the movable member.
Figure 13:
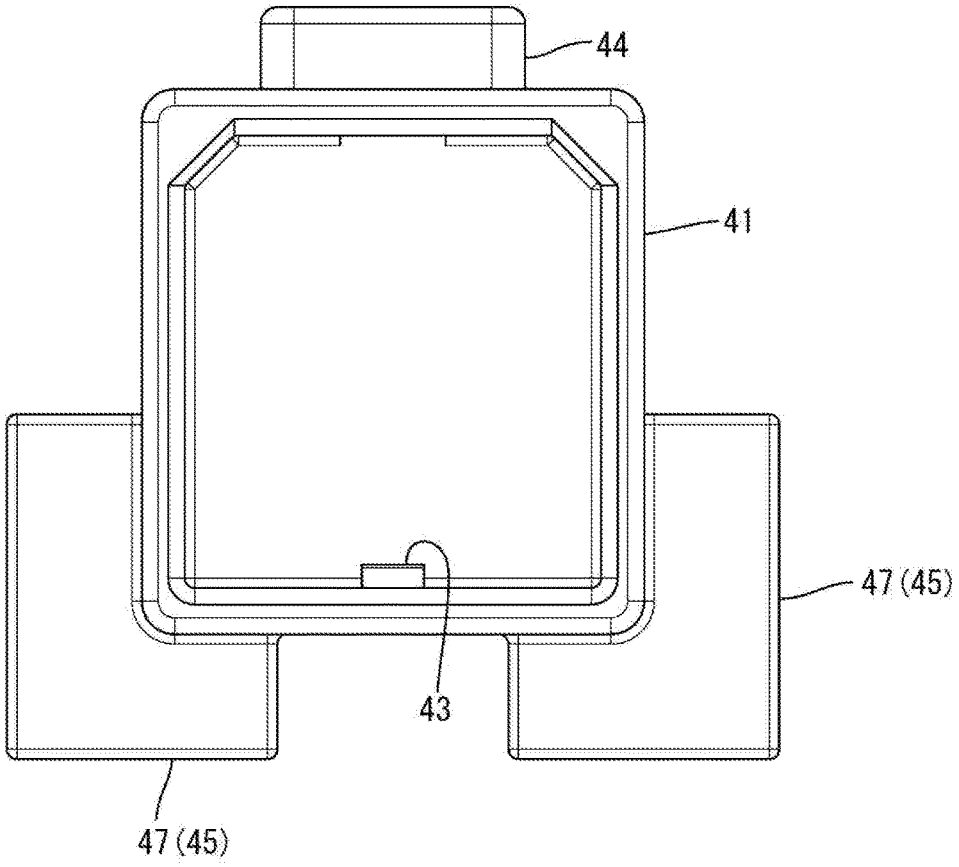
FIG. 13 is a bottom view of the movable member.

As shown in FIGS. 8 and 12, the held portion 45 has two engaging pieces 47 and a resilient lock 49. The engaging pieces 47 are rectangular plates at an upper part of the movable member 40 and project rearward and out in the width direction of the movable member 40 in a plane normal to the connecting direction of the connector 10. The resilient lock 49 extends in an extending direction of the engaging pieces 47 (front-rear direction) within the plane perpendicular to the connecting direction of the connector 10 and is vertically displaceable. The resilient lock 49 is at a substantially central position in the width direction of the movable member 40 and is cantilevered from a part between the engaging pieces 47. The resilient lock 49 is above the opening 36. A protrusion 49A is at a front extending end part of the resilient lock 49 and projects up toward the attaching member 60 for locking an edge of a hole of an accommodating portion 73 of the attaching member 60 to be described later. Further, the resilient lock 49 is accommodated in a box-shaped resilient locking piece accommodating portion 44 that opens up and forward. A lower end of the resilient locking piece accommodating portion 44 is slightly in the upper wire accommodating portion 41, whereas an upper end position of the resilient locking piece accommodating portion 44 is flush with the engaging pieces 47. Further, the resilient locking piece accommodating portion 44 projects more forward than the upper wire accommodating portion 41.

As shown in FIGS. 1 and 2, the attaching member 60 is a holding portion 70 with an engaging groove 71 to be engaged with the engaging pieces 47 and the accommodating portion 73 to which the resilient locking piece 49 is to be locked. The attaching member 60 includes a block-shaped attaching member body 61 and a projecting portion 63 for forming the accommodating portion 73. The attaching member body 61 is smaller in the front-rear direction than the connector 10 and is at a position displaced toward the rear end of the connector 10. Further, the projecting portion 63 projects forward from a widthwise central position of the attaching member body 61, and the accommodating portion 75 is provided inside.

Holding pieces 65 project down from both widthwise ends of the attaching member body 61 by a thickness of the engaging pieces 47 and then extend in to define L-shapes. Further, the holding pieces 65 are provided over the entire length of the attaching member body 61 in the front-rear direction. The engaging groove 71 is enclosed by the lower surface of the attaching member body 61 and the upper surfaces of the holding pieces 65. The engaging groove 71 extends in the front-rear direction, which is a direction intersecting a projecting direction of the engaging pieces 47. More specifically, the engaging groove 71 extends in the front-rear direction over the entire length of the attaching member body 61 and has an open front end, whereas a rear stop wall 67 is provided on the rear end. A hole 67A in the rear stop wall 67 communicates with the engaging groove 71, and outer hole edges are flush with inner surfaces on widthwise outer sides of the engaging groove 71.

As shown in FIGS. 1 and 2, the accommodating portion 73 accommodates the protrusion 49A of the resilient lock 49. The accommodating portion 73 is a substantially rectangular upward recess on lower surfaces of the projecting portion 63 and the attaching member body portion 61. The accommodating portion 73 is at a substantially middle position between the holding pieces 65 (engaging groove 71) in the width direction. The movable member 40 is stopped in front by locking the protrusion 49A of the resilient lock 49 to a front hole of the accommodating portion 73.

As shown in FIGS. 1 and 2, the engaging pieces 47 are fit in the engaging groove 71 with clearances C1 in the width direction between the engaging pieces 47 and the inner wall of the engaging groove 71, the edge of the hole 67A of the rear stop wall 67. Further, clearances also are provided in the width direction between the resilient lock 49 and the inner wall of the accommodating portion 73 so as not to obstruct movements of the engaging pieces 47 in the width direction in the clearances C1. Further, the holding pieces 65 hold lower sides of the engaging pieces 47 so that the movable member 40 will not come off the attaching member 60.

As shown in FIGS. 1 and 2, the resilient locking piece 49 is accommodated in the accommodating portion 73 with a clearance C2 formed in the front-rear direction between the protrusion 49A and the inner wall of the accommodating portion 73. Further, the engaging pieces 47 are movable rearward until the movable member 40 contacts the rear stop wall 67 and the engaging groove 71 is open forward. Thus, the engaging pieces 47 do not obstruct a movement of the protrusion 49A of the resilient lock 49 in the front-rear direction in the clearance C2. Note that the engaging pieces 47 have a length in the front-rear direction sufficient to fit into the engaging groove 71 even if the resilient locking piece 49 moves to a foremost side.

As described above, the movable member 40 is held movable within a plane (left, right, forward and downward directions) perpendicular to the connecting direction with the engaging pieces 47 and the resilient locking piece 49 serving as the held portion 45 held with the clearances C1, C2 in the engaging groove 71 and the accommodating portion 73 serving as the holding portion 70. That is, the connector 10 is held in the attaching member 60 movably within the plane perpendicular to the connecting direction in the clearances C1 in the width direction and the clearance C2 in the front-rear direction.

As shown in FIGS. 2 and 8, the female terminal 50 includes a connecting portion 51 connectable to the male terminal 91 and a barrel 53 integral with the connecting portion 51 above the connecting portion 51. The connecting portion 51 is a rectangular tube that opens up and down. The male terminal 91 is inserted from below and contacts a resilient contact piece in the connecting portion 51 so that the female terminal 50 and the male terminal 91 are connected electrically.

The barrel 53 includes a wire barrel 53A to be crimped to an exposed core of the wire W at an end of the wire W and an insulation barrel 53B to be crimped to an insulation coating of the wire W. A rubber plug 55 is mounted on the wire W and the insulation barrel 53 is crimped to this rubber plug 55 together with an insulation coating of the wire W. The rubber plug 55 is accommodated into the cavity 31, thereby being held in close contact with the outer peripheral surface of the wire W and the inner surface of the cavity 31.

The assembling of the connector 10 is described with reference to FIGS. 2 and 8. In assembling the connector 10, the female terminals 50 connected by one wire W are inserted into the respective cavities 31 through the opening 36 of the lower wire accommodating portion 27. When being inserted to a proper position, each female terminal 50 is locked primarily locked by the locking lance 33. The retainer 23 is mounted when the female terminals 50 are accommodated at the proper positions in the cavities 31 and secondarily locks the female terminals 50.

With the female terminals 50 locked at the proper positions, the wire W is folded forward and accommodated into the lower wire accommodating portion 27. Then, with the wire W accommodated in the lower wire accommodating portion 27, the movable member 40 is mounted. Specifically, the movable member 40 is mounted from above the housing body 21 and the upper wire accommodating portion 41 is fit externally to the lower wire accommodating portion 27. At this time, the coupling wall 37 contacts the locking projection 43 in the upper wire accommodating portion 41 and is deflected and deformed forward. When the locking projection 43 reaches the locking hole 39, the coupling wall 37 returns and the locking projection 43 is locked to the edge of the locking hole 39 to lock the movable member 40 to the housing 20. Then, the upper wire accommodating portion 41 covers the coupling wall 37 to prevent the coupling wall 37 from being inadvertently deflected and unlocked.

The connector 10 is attached to the attaching member 60 after the movable member 40 is assembled. As shown in FIGS. 1 and 2, the engaging pieces 47 of the movable member 40 are inserted into and engaged with the engaging groove 71 of the attaching member 60 from the front to assemble the connector 10 with the attaching member 60. At this time, the resilient locking piece 49 is deflected and deformed down and the engaging pieces 47 reach a proper position in the engaging groove 71, the protrusion 49A of the resilient locking piece 49 of the movable member 40 is accommodated into the accommodating portion 73 and the connector 10 is retained so as not to be detached from the attaching member 60. As just described, the resilient locking piece 49 extends in the projecting direction (front-rear direction) of the engaging pieces 47. Thus, the resilient locking piece 49 can be locked and retained in the accommodating portion 73 only by pushing the movable member 40 into the attaching member 60 with the engaging pieces 47 engaged with the engaging groove 71. In this way, the connector 10 is held movably in the forward, rearward, leftward and rightward directions with respect to the attaching member 60.

The connection of the connector 10 and the waiting connector 90 is described with reference to FIGS. 1 and 2. In mounting the attaching member 60 and the cover into the opening 81 of the case 80, the connector 10 is inserted into the opening 81 and arranged to face the waiting connector 90. The cover then is mounted to close the opening 81 so that the connectors 10, 90 are connected, and the attaching member 60 is fixed to the case 80 via the cover.

Here, it is assumed that axial centers of the connector 10 and the waiting connector 90 are displaced slightly when the attaching member 60 is attached to the case 80. In this case, the connector 10 is movable relative to the attaching member 60 in the forward, rearward, leftward and rightward directions (directions perpendicular to the connecting direction) by the clearances C1, C2. Thus, the fitting 25 moves along the tapered surface of the receptacle 97 and the fitting 25 of the connector 10 is centered and reliably fit into the receptacle 97 of the waiting connector 90. Further, when the connector housing 20 and the waiting housing 95 are connected, the male terminals 91 contact the female terminals 50 in the connector housing 20 to configure the interlock circuit.

As just described, the connector 10 is held movably in the attaching member 60. Thus, a positional displacement with respect to the waiting connector 90 can be corrected. On the other hand, if the vibration of the vehicle is transmitted to the connector 10 after the waiting connector 90 and the connector 10 are connected properly, the connector 10 may move relative to the waiting connector 90 and contact points between the male terminals 91 and the female terminals 50 may slide to be abraded.

However, in this embodiment, the press-fit ribs 35 are on a tip part of the fitting 25. The press-fit ribs 35 are pressed into contact with the inner surface of the receptacle 97 and are squeezed when fitting the fitting 25 into the receptacle 97, thereby fixing the fitting 25 and the receptacle 97. At this time, the press-fit ribs 35 are at plural positions on the side surfaces facing each other. Thus, the fitting 25 is fixed firmly to the receptacle 97 even if forces in various directions are applied. In this way, the contact points between the male terminals 91 and the female terminals 10 cannot slide finely to be abraded due to the vibration of the connector 10 in the waiting housing 95 and there is no reduction of connection reliability between the male terminals 91 and the female terminals 50. Note that since the press-fit ribs 35 are on the outer periphery located outward of the positions where the male terminals 91 and the female terminals 50 are connected, the transmission of vibration to the female terminals 50 can be reduced and fine sliding abrasion of the terminals 50, 91 is prevented more effectively as compared to the case where press-fit ribs are at positions vertically spaced from the contact positions of the female terminals 50.

Further, the rubber plugs 55 are mounted on the wire W connected to the female terminals 50. The rubber plug 55 is held in close contact with the outer peripheral surface of the wire W and the inner surface of the cavity 31 so that the wire W is fixed to the cavity 31 via the rubber plug 55. Thus, even if vibration is transmitted to the wire W, the wire W does not move relative to the cavity 31, and a relative movement of the female terminal 50 connected to the wire W can be suppressed.

As described above, the housing 20 and the movable member 40 are separate members used by being coupled, and the housing 20 and the movable member 40 are reduced in size as compared to the case where a housing is integral with a moving structure with respect to an attaching member. Thus, even if a moving structure for the attaching member 60 is provided after the female terminals 50 and the wire W are accommodated into the housing 20, the entire length of the housing 20 can be shortened and the occurrence of a molding failure can be suppressed. Further, since the moving structure such as the resilient locking piece 49 is arranged above the opening 36 for inserting the female terminals 50, the entire connector housing can be miniaturized.

The invention is not limited to the above described and illustrated embodiment. For example, the following embodiments also are included in the scope of the invention.

Although the terminals to be accommodated into the connector 10 are the female terminals 50 in the above embodiment, these terminals may be male terminals and mating terminals may be female terminals.

Although the rubber plugs 55 are mounted on the wire W in the above embodiment, no rubber plug may be used.

Although the press-fit ribs 35 are provided on each side surface in the above embodiment, only one press-fit rib may be provided as a whole or a plurality of press-fit ribs may be provided on facing side surfaces. Further, no press-fit rib may be provided.

Although the connector 10 is a connector constituting the interlock circuit in the above embodiment, the connector 10 may be another connector if this connector is movably held in the attaching member.

LIST OF REFERENCE SIGNS

10 . . . connector
20 . . . housing
21 . . . housing body
25 . . . fitting
27 . . . lower wire accommodating portion

31 . . . cavity
35 . . . press-fit rib
36 . . . opening
37 . . . coupling wall
39 . . . locking hole
40 . . . movable member
41 . . . upper wire accommodating portion
43 . . . locking projection
45 . . . held portion
47 . . . engaging piece
49 . . . resilient lock
50 . . . female terminal
55 . . . rubber plug
60 . . . attaching member
61 . . . attaching member body
63 . . . projecting portion
65 . . . holding piece
67 . . . rear stop wall
67A . . . hole
70 . . . holding portion
71 . . . engaging groove
73 . . . accommodating portion
80 . . . case
81 . . . opening
90 . . . waiting connector
91 . . . male terminal
95 . . . waiting housing
97 . . . receptacle
W . . . wire

What is claimed is:

1. A connector to be mounted into an attaching member provided detachably to a case of a device accommodating a waiting connector to face the waiting connector and to be connected to the waiting connector, comprising:

a housing having housing peripheral walls defining a housing cavity, the housing cavity being open in a first direction, and the housing peripheral walls including a resiliently deflectable coupling wall having a lock hole formed therein;

at least one terminal accommodated in the housing cavity, the at least one terminal having a wire extending from an end of the at least one terminal in the first direction; and a movable member having a movable member peripheral wall and a movable member cavity formed therein, the movable member being open in a second direction opposite the first direction, a locking projection projecting on an inner surface of the movable member peripheral wall, the movable member being disposed surrounding the housing so that the housing is accommodated in the movable member cavity with the locking projecting engaging the lock hole, and the movable member including a held portion to be held movably within a plane perpendicular to a connecting direction to the waiting connector with respect to a holding portion provided in the attaching member; wherein the locking projection and the lock hole define a coupling configured to couple the housing and the movable member; and the movable member and the housing defining a wire accommodating portion for accommodating the wire extending from the at least one terminal.

2. The connector of claim 1, wherein:

the at least one terminal is insertable into the housing cavity through the opening (36);

an engaging piece serving as the held portion and to be engaged with an engaging groove provided as the holding portion is provided on an end part of the movable member on the side of the attaching member;

the engaging piece projects in a predetermined direction within a plane perpendicular to the connecting direction to the waiting connector;

the engaging groove extends in a direction intersecting a projecting direction of the engaging piece within the plane perpendicular to the connecting direction to the waiting connector;

a clearance for moving the connector in an extending direction of the engaging groove is provided between the engaging piece and an inner wall of the engaging groove;

the movable member includes a resilient lock serving as the held portion and to be locked to an accommodating portion provided as the holding portion;

the resilient lock projects toward the attaching member within the plane perpendicular to the connecting direction to the waiting connector and extends in the projecting direction of the engaging piece;

a clearance for moving the connector in an extending direction of the resilient lock (49) is provided between the resilient lock and the accommodating portion; and the resilient lock is arranged above the opening.

3. The connector of claim 2, wherein:

a press-fit rib configured to fix the housing and a waiting housing of the waiting connector by being pressed into contact with an inner surface of the waiting housing to be squeezed in connecting the housing to the waiting housing is provided on an outer surface of the housing; and a rubber plug mounted on the wire and held in close contact with an outer peripheral surface of the wire and a cavity of the housing, the terminal being accommodated in the cavity.

* * * * *